United States Patent [19]

Kapich

[11] Patent Number: 4,874,288

[45] **Date of Patent: * Oct. 17, 1989**

[54] INLET GUIDE VANE ASSEMBLY

[76] Inventor: D. Davorin Kapich, 3111 Serrano Dr., Carlsbad, Calif. 92009

[ * ] Notice: The portion of the term of this patent subsequent to Aug. 16, 2005 has been disclaimed.

[21] Appl. No.: 189,653

[22] Filed: May 3, 1988

Related U.S. Application Data

[63] Continuation-in-part of Ser. No. 40,858, Apr. 21, 1987, Pat. No. 4,764,088.

[51] Int. Cl.[4] ..... F04D 29/36

[52] U.S. Cl. ..... 415/150; 415/29; 415/49; 415/148; 415/156

[58] Field of Search ..... 415/26, 29, 42, 48, 415/49, 146, 147, 148, 149 R, 150, 151, 156, 157

[56] References Cited

U.S. PATENT DOCUMENTS

| | | | |
|---|---|---|---|
| 3,861,823 | 1/1975 | Serovy | 415/151 |
| 4,484,857 | 11/1984 | Patin | 415/150 |
| 4,764,088 | 8/1988 | Kapich | 415/150 |

*Primary Examiner*—Robert E. Garret
*Assistant Examiner*—John T. Kwon
*Attorney, Agent, or Firm*—John R. Ross, Jr.

[57] ABSTRACT

An inlet guide vane assembly for a pump or a compressor having rotary blades. The guide vanes pivot in a controlled manner so that a portion of the vanes can be inserted into or withdrawn from the inlet passageway of the pump or the compressor by pivoting the guide vanes about a pivot axis.

10 Claims, 2 Drawing Sheets

INLET GUIDE VANE ASSEMBLY

This invention is a continuation in part, of Ser. No. 07/040,858, now U.S. Pat. No. 4,764,088.

BACKGROUND OF THE INVENTION

This invention relates to the pumps and compressors which incorporate adjustable inlet guide vanes for purpose of directing the fluid flow into the pump or the compressor rotating impeller.

Rotating fluid pumps and compressors are normally designed to operate best at specific fluid flow rate, pressure rise and rotating speed conditions. Process fluid flow systems often demand changes in the fluid flow rate, while maintaining relatively constant pressure rise. Such applications, very often employ pumps or compressors, operating at substantially constant rotating speed and include fluid flow control systems which bypass the excess fluid flow back to the pump or the compressor inlet by throttling of such fluid flow. Other control systems may utilize throttling of the entire pump flow, without the flow bypass. In such cases, a decrease in the fluid flow rate entering the pump or the compressor impeller causes a decrease in the axial fluid velocity while the rotational velocity of the impeller blades remains substantially constant. Such a condition causes higher relative inlet flow angle with respect to impeller blades, contributing to increase of blade inlet losses which negatively affect the pump efficiency and can produce unstable flow through the pump. Inlet guide vanes, producing pre rotation of the fluid flow in the direction of the impeller rotation, will decrease such high relative inlet flow angle, thus decreasing the blade inlet losses and increasing the impeller efficiency at such low flow conditions. Other applications, such as rotating air compressors used with turbochargers, boosting the pressure of internal combustion engines, are normally designed to achieve peak efficiency under pre-determined operating conditions. Change in the output power and rotating speed of internal combustion engine usually requires a cooresponding changes of charge air flow rate and the boost pressure delivered by the turbocharger to the engine. Such changes may result a decrease in the charge air flow rate, while the boost pressure demand remains disproportionally high. For instance, a reduction in the engine speed under high load conditions, usually decreases the ratio of the inlet air flow velocity relative to the rotatinal velocity of the turbocharger compressor blades, thereby producing higher inlet flow angle with respect to compressor impeller blades. Carefull matching of the turbocharger design to the specific engine requirements is needed, in order to avoid unstable compressor flows at such low flow conditions. Inlet guide vanes, causing pre-rotation of the air flow in the direction of the compressor rotation will, under such conditions, decrease the flow angle between the impeller blades and the air flow, thus allowing the turbocharger to achieve lower flow rates and increase its usefull flow range, while maintaining efficient compressor inlet flow conditions. Additionally, a fast responce of the inlet guide vanes system, when needed, during the engine and turbocharger acceleration, would be benefitial to the overall engine performance.

The use of inlet guide vanes in pumps and compressors to reduce the inlet flow angle for operating at conditions other than optimum is well known to the art.

George K. Serovy U.S. Pat. No. 3,861,823 illustrates the use of inlet guide vanes, which are radially retractable in a linear fashion and which include automatic control system external to the fluid compressor. Such a control system, being connected to a system of ring gear, multiple pinion gears and rack members, inserts and retracts the guide vanes relative to the fluid flow.

Bladed turbine pump with adjustable guide vanes, in which the inlet guide vanes are linked to the second set of vanes located in the pump outlet, is described in the Pierre Patin U.S. Pat. No. 4,484,857. Such inlet guide vanes, being lengthwise pivotable, are continously submerged in the flow.

These approaches, while providing the desired inlet flow angle at part flow or at some other less than optimum conditions, use mechanical actuation systems, often employing ring gear, pinion gears, rack gears and levers. In order to maintain precise guide vanes alignment, such systems usually require a high degree of precision and minimum internal clearances between the mating parts, while at the same time allowing for manufacturing tolerances and thermal expansion differences that may occur in operation. Such mechanisms usually have relatively low tolerance toward particulate contamination between such mating parts. Repetitive cycling of such systems, with inlet guide vanes being subject to a great deal of turbulence generated by relatively high fluid velocities, tend to induce chatter and vibration into the guide vanes systems, which may lead to premature wear and malfunction of moving parts. Actuation systems, having multiple internal clearances in series, and which are required to transmit reversable motions, may also lag in responce when required to produce rapid and precise change of the inlet flow direction. Therefore, it would be desirable for such system to have a minimum mass inertia and no mechanical clearances between the individual parts.

It would be also desirable, for such guide vanes system, to be relatively insensitive to a particulate contamination in the fluid flow, with respect to its functional performance.

SUMMARY OF THE INVENTION

It is an object of this invention to provide, a guide vane assembly which guide the fluid flow in a desired direction only when required and to have a minimum interference with the fluid flow when not in use.

It is further object of this invention to provide a guide vane assembly which utilizes pump discharge pressure, acting on a single coaxial annular piston, to directly adjust the position of such inlet guide vanes, by pivoting said guide vanes into and out of the fluid flow.

It is still further object of this invention to provide a guide vane assembly which utilizes automatic control means to adjust the position of inlet guide vanes, to properly improve the inlet flow angle of the fluid under conditions other than the optimum design conditions.

It is still further object of this invention to provide a guide vane assembly which, while fulfilling the above objects, utilizes continous mechanical loading of such guide vanes, to maintain zero clearances between the actuation piston and the pivoting guide vanes.

It is still further object of this invention to provide a guide vane assembly which, while fulfilling the above objects, is simple and efficient in design.

An inlet guide vane assembly for a pump or a compressor having rotary blades is provided. The guide vanes of the assembly are pivotably disposed in a housing defining an fluid flow passageway so that a portion of the vanes can be inserted into or withdrawn from the passageway by pivoting the guide vanes about a pivot axis. Control means is provided for controling the degree of pivot.

BRIEF DESCRIPTION OF THE DRAWINGS

These and other objects of the invention will become apparent from a study of the following specifications and drawings, in which.

DESCRIPTION OF THE PREFERRED EMBODIMENT

Figure 1:
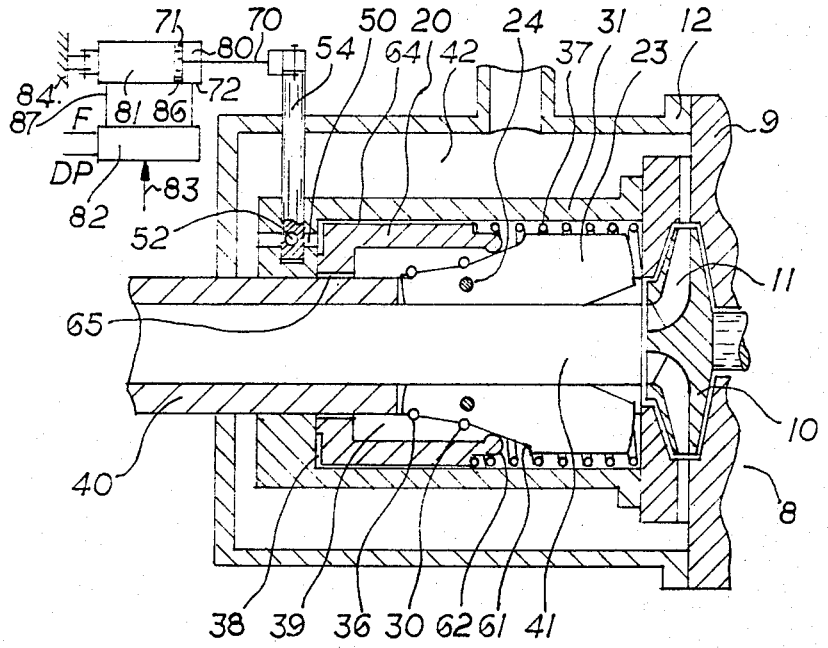
FIG. 1 is a sectional elevation of the pump incorporating the invention, with the guide vanes removed from the fluid flow.

With particular reference to FIGS. 1, 2, 3 and 4, a pump incorporating the principles of the present invention is generally indicated by the reference numeral 8. Such pump 8 includes blades 11 being a part of the bladed impeller 10, which is rotatably mounted to the housing 9 and is further contained within pump housing 12. The inlet pipe 40 is providing the base for a plurality of bearing grooves supporting the pivot axis 24 which are rigidly connected to the inlet guide vanes 23. The inlet pipe 40 together with the piston housing 31 are rigidly connected to the housing 9.

The inlet guide vanes are configured as flat surfaces at the flow enterance and are curved at the trailing edges to a desired angle. Such angle may vary along the radial lenght of the vanes 23 for a purpose which will be explained later. The relative position of individual vanes 23 is such, as to form together with the inlet pipe 40, a series of efficient flow turning passages when the vanes are fully inserted into the fluid flow. The inlet pipe 40 includes radial slots 19, allowing the guide vanes 23 to pivot freely about the pivot axes 24, while being guided by the radial slots 19 in peripheral and axial directions, said slots 19 being configured in close proximity to the guide vanes 23, thus preventing excessive side-movement of such vanes, and at the same time preventing excessive fluid flow exchange between flow passage 41 and the cavities 38 and 39. A elastic band 30, being expanded peripherally over the ridges formed by guide vanes 23, and located substantially over the pivot centres formed by the guide vane pivot axes 24, is loading said guide vanes in a inward direction, thus resulting in a continous contact between pivot axes 24 and bearing groves configured in the inlet pipe 40. A elastic band 36, being expanded peripherally over the ridges formed by the guide vanes and located substantially of center relative to pivot axes 24, is loading said guide vanes in a way to affect said guide vanes to pivot in the direction of retracting said guide vanes from the fluid flow. For reasons which will be described further on, the annular ridge 62, being a portion of the annular piston 20 is at all times in a sliding contact relationship with the guide vanes ridges 61 thus counterbalancing the moment caused by the action of said elastic band 36. The position of the guide vanes 23 is therefore, directly governed by the axial position of the annular piston 20, which is movable in axial direction, while compressing the spring 37 to a degree proportional to its axial motion.

A valve stem 54, configured with the flow passage 52 is rotatably mounted in the piston housing 31 and pump housing 12. By rotating the valve stem 54, the valve passage 52 can align to a varying degree with the passage 50 configured in the piston housing 31, thus selectively opening or closing said passages. Since the highest fluid pressure is in the pump discharge cavity 42, the change in the flow area of the valve 52, will pressurize to a varying degree cavity 38, thus directly affecting the pressure differential across the piston 20. The fluid pressure in the cavity 39 is nearly equal to the pressure in the flow passage 41 due to close communication of cavity 39 and the passage 41 through the slots 19, thus causing the pressure in the cavity 39 to be nearly the same as the pump inlet pressure. As shown on FIG. 1, the valve passage 52 is in a position of preventing fluid communication between the pump discharge cavity 42 and the cavity 38. Due to the annular gaps 64 and 65, between the piston 20 and piston housing 31 and the inlet pipe 40, the fluid pressure around the piston 20 is substantially equalized. Since the free length of the spring 37 is longer than the maximum allowable space, the force generated by the spring 37 holds the piston 20 in a solid contact with the piston housing 31, thus allowing the guide vanes to be fully retracted from the annular passage 41, by the action of elastic band 36. The force caused by the compression of spring 37, being linearly proportional to the axial displacement of said spring, is being counterbalanced by a fluid pressure difference between cavities 38 and 39. As described earlier, the valve passage 52 can prevent direct fluid communication between pump discharge cavity 42 and cavity 38 such as shown on FIG. 1, or it can be positioned to be aligned with the passage 50 as shown in the FIG. 2, allowing for direct and relatively unobstructed fluid flow communication between the cavities 42 and 38, in which case, the cavity 38 is being pressurized to a value higher than the cavity 39. The resulting pressure difference between the cavity 38 and cavity 39 is being counterbalanced by the force of the compressed spring 37 and by the axial component of the force acting on the contour 62 of the piston 20, due to the contact with the contour 61 of the guide vanes 23. A fluid flow relationship between the degree of opening of the valve passage 52 and the pressure in the cavity 38, is affected by the pressures in the cavity 42 and the inlet passage 41, and by the fluid leakage through the gaps 64 and 65. By a suitable design choice of springs 37 and 36, shape of the guide vane ridge contour 61, frontal area of piston 20, size of gaps 64 and 65, and flow area of the valve 52 with relation to the pump differential pressure, a desired balance can be achieved between the fluid and the spring forces, at all guide vanes postions, ranging from fully retracted position as shown on FIG. 1, to fully inserted position as shown on FIG. 2.

Figure 2:
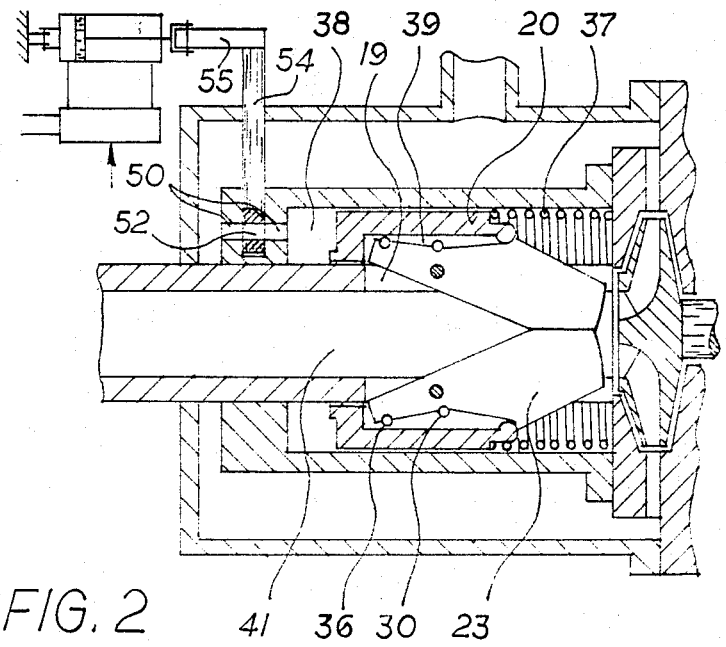
FIG. 2 is a sectional elevation of the pump incorporating the invention, with the guide vanes fully inserted into the fluid flow.

The principal control elements are shown schematically in FIG. 1 and 2. A hydraulic cylinder 72 is anchored at one end to a pump or a compressor frame 84. Said hydraulic cylinder 72 includes piston 71 which is attached to a arm 55 of the valve stem 54 by a control rod 70. A control unit 82, interposes the cylinder 72 and the fluid source 83, receives an input signal such as pump discharge pressure or flow, designated by arrows DP and F, respectively. In responce to the input signal, the control unit modulates the flow from the supply source to the hydraulic cylinder 72 by way of conduits 86 and 87, communicating respectively with internal chambers 80 and 81 located within cylinder 72.

Pump or the compressor performance may be easily measured by sensing the flow or the discharge pressure signals, which may be transmitted as a fluid pressure or as electrical signals to the control unit 82. For example, a decrease in the pump flow, transmitting such signal to the control unit 82, will cause the hydraulic fluid to enter the chamber 80 and proportionally to discharge the hydraulic fluid from the chamber 81, causing the piston 71 and control rod 70 to move arm 55 and rotate the valve stem 54, causing the passages 50 and 52 to open, allowing the pump discharge pressure to cause the fluid flow from cavity 40 to the cavity 38, causing the piston 20 to compress spring 37 and cause insertion of the guide vanes into the inlet flow annulus 41. A simmilar effect may be accomplished in principle by utilizing the discharge pressure signal or both signals, where the control unit is preprogrammed to compute the proper response of the hydraulic system actuating the piston 71.

Figure 4:
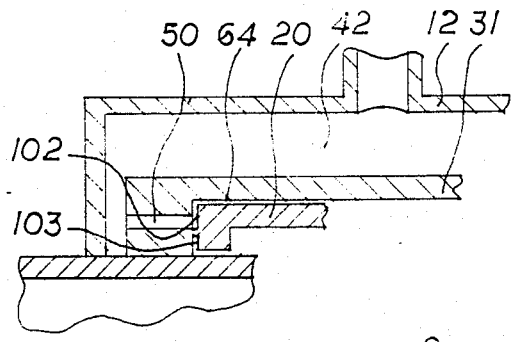
FIG. 4 is a sectional view incorporating an alternate configuration of a flow passage controlling the guide vanes.
Figure 5:
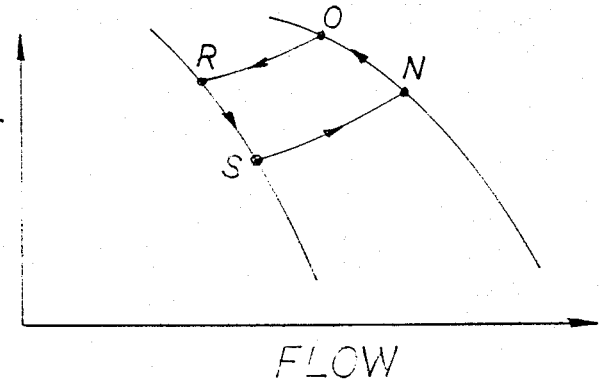
FIG. 5 is a diagram representing pressure rise as a function of flow, of a typical centrifugal pump and representing also the operating points of the alternate control means shown on FIG. 4.

A alternate guide vanes control system shown in FIG. 4, utilizes variation of the pump discharge pressure in the cavity 42, to cause a move of the inlet guide vanes 23 from a fully withdrawn position to a fully inserted position and vice versa. When the piston 20 is in its most leftward position, the vanes are fully withdrawn, the pump discharge pressure is applied via passage 50 to the piston area indicated by numeral 102, while the piston area 103 is subjected to a substantially pump inlet pressure. Such vanes position is typically represented by the line between the points N and O on the pressure-flow diagram shown on FIG. 5. When the pump pressure reaches the point O, the force acting on piston 20 causes the piston to move rightwards, exposing additional surface 103 to the pump discharge pressure thus increasing the force in the right direction thus causing the piston 20 to move to the right and inserting the guide vanes into the flow passage 41. Such operating condition is typically represented by the line between the points R and S on FIG. 5. Conversely, decrease in pump pressure across the piston 20 will cause the piston to move in the leftward direction thus causing the guide vanes to withdraw from the flow passage 41, returning the guide vanes back to the innitially described position.

Figure 3:
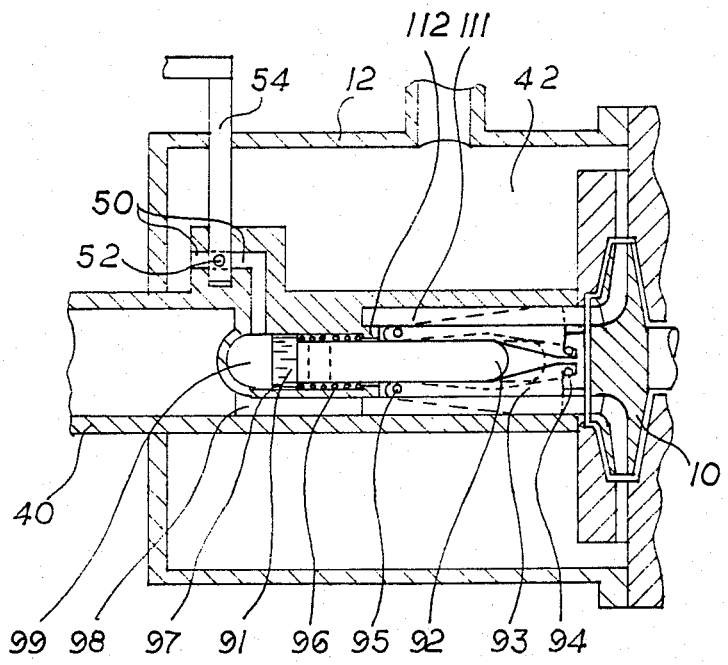
FIG. 3 is a sectional elevation of the pump incorporating an alternate configuration of guide vanes assembly.

FIG. 3 shows an alternate guide vanes configuration in which, the vanes are shown to be withdrawn from the annular passage 111 into a center body 112 containing also the cylindrical piston 91, the vane actuation body 92 and the spring 96 as solid lines. The inserted vanes position and the cooresponding position of piston 91 and the actuation body 92 is shown by the broken lines. The pivot axes of the vanes are shown as numerals 95, the return spring as numeral 94, the radial gap between the piston 91 and the bore in the center body 112 as numeral 97, the stationary vanes supporting the center body 112 and containing the fluid flow actuation passage 50 as numerals 98. The guide vanes positioning control system and the ballance of the fluid and spring forces is the same in principle as the one shown in FIG. 1 and 2, with basic difference being in the configuration of the vanes assembly being contained within the center body positioned centrally into the inlet pipe 40.

From the foregoing it will be appreciated that the present invention provides novel and improved inlet guide vane system. While a preffered embodiment of the invention is described and illustrated herein, there is no intent to limit the invention to this or any particular embodiment.

What is claimed is:

1. An inlet guide vane assembly for a pump or a compressor having rotary blades comprising:

a housing means defining an passageway for providing a fluid passageway to said rotary blades, a plurality of guide vanes, each of said guide vanes being pivotably disposed in said housing means so that by pivoting said vane about a pivot axis said guide vane may be inserted into or removed from said passageway, the extent of such insertion being determined by the degree of pivot of said vane about said axis, a control means to control the degree of pivot of said guide vanes, wherein the passageway defined by said housing is an circular passageway, wherein said control means comprises an annular piston disposed in said housing means so that axial movement of said piston will apply a force on said plurality of guide vanes causing pivotal movement of said plurality of guide vanes, wherein said control means further comprises a pressure means for applying a pressure differential across said annular piston to cause said piston to move axially, wherein said control means further comprises a counteracting force means to apply forces counteracting forces exerted by said pressure means, wherein said pressure means further comprises a fluid flow passageway means permitting fluid passage from the discharge of said pump or a compressor to said annular piston such that the pressure of said discharge is utilized to apply the pressure differential across said piston, wherein said pressure means further comprises a control valve disposed in said fluid flow passage means and the configuration of said piston in said housing means is such as to permit fluid leakage past such piston so that the pressure on said piston can be controled by adjustments of said control valve.

2. The assembly of claim 1 wherein said pressure means further comprises an automatic control means for automatically adjusting said control valve.

3. The assembly of claim 1 and further comprising a first elastic means for applying to said plurality of guide vanes a radial force at their pivot axis to assure continous contact of said vane to said housing at the pivot axis.

4. The assembly of claim 1 and further comprising a second elastic means for applying a radial force to said plurality of guide vanes to counteract the force applied to said plurality of guide vanes by said piston.

5. The assembly of claim 1 wherein the inserted portion of said guide vanes are configured with straight surfaces and curved surfaces said curved surfaces being downstream in said circular fluid passageway from said straight surfaces.

6. The assembly of claim 1 wherein said guide vanes when fully inserted are contacting each other along a straight line.

7. An inlet guide vane assembly for a pump or a compressor having rotary blades comprising:

a housing means defining an passageway for providing a fluid passageway to said rotary blades, a plurality of guide vanes, each of said guide vanes being pivotably disposed in said housing means so that by pivoting said vane about a pivot axis said guide vane may be inserted into or removed from said passageway, the extent of such insertion being determined by the degree of pivot of said vane about said axis, a control means to control the degree of pivot of said guide vanes, wherein the passageway defined by said housing is an annular passageway, wherein said control means comprises an circular piston disposed in said housing means so that axial movement of said piston will apply a force on said plurality of guide vanes causing pivotal movement of said plurality of guide vanes, wherein said control means further comprises a pressure means for applying a pressure differential across said circular piston to cause said piston to move axially, wherein said control means further comprises a counteracting force means to apply forces counteracting forces exerted by said pressure means, wherein said pressure means further comprises a fluid flow passageway means permitting fluid passage from the discharge of said pump or a compressor to said circular piston such that the pressure of said discharge is utilized to apply pressure differential across said piston, wherein said pressure means further comprises a control valve disposed in said fluid flow passage means and the configuration of said piston in said housing means is such as to permit fluid leakage past such piston so that the pressure on said piston can be controled by adjustments of said control valve.

8. The assembly of claim 7 wherein said pressure means further comprises an automatic control means for automatically adjusting said control valve.

9. The assembly of claim 7 and further comprising elastic means for applying to said plurality of guide vanes a radial force to counteract the force applied to said plurality of guide vanes by said piston.

10. An inlet guide vane assembly for a pump or a compressor having rotery blades comprising:

a housing means defining an passageway for providing a fluid passageway to said rotary blades, a plurality of guide vanes, each of said guide vanes being pivotably disposed in said housing means so that by pivoting said vane about pivot axis said guide vane may be inserted into or removed from said passageway, the extent of such insertion being determined by the degree of pivot of said vane about said axis, a control means to control the degree of pivot of said guide vanes, wherein the passageway defined by said housing is an circular passageway, wherein said control means comprises an annular piston disposed in said housing means so that axial movement of said piston will apply a force on said plurality of guide vanes causing pivotal movement of said plurality of guide vanes, wherein said control means further comprises a pressure means for applying a pressure differential across said annular piston to cause said piston to move axially, wherein said control means further comprises a counteracting force means to apply forces counteracting forces exerted by said pressure means, wherein said pressure means further comprises a constant geometry fluid flow passageway means permitting fluid flow passage from the discharge of said pump or a compressor to said annular piston such that the pressure of said discharge is utilized to apply the pressure differential across said piston and the configuration of said piston in said housing means is such as to permit fluid leakage past such piston so that the pressure force across said piston is controled by the pressure rise across said pump or a compressor.

* * * * *